US008918914B2

(12) United States Patent
Estorge

(10) Patent No.: US 8,918,914 B2
(45) Date of Patent: Dec. 30, 2014

(54) BASEBALL GLOVE WITH VISUAL INDICIA

(76) Inventor: Mark Estorge, Baton Rouge, LA (US)

( * ) Notice: Subject to any disclaimer, the term of this patent is extended or adjusted under 35 U.S.C. 154(b) by 82 days.

(21) Appl. No.: 13/606,508

(22) Filed: Sep. 7, 2012

(65) Prior Publication Data

US 2013/0061363 A1 Mar. 14, 2013

Related U.S. Application Data

(60) Provisional application No. 61/532,846, filed on Sep. 9, 2011.

(51) Int. Cl.
*A41D 13/08* (2006.01)
*A63B 71/14* (2006.01)

(52) U.S. Cl.
CPC ..... *A63B 71/143* (2013.01)
USPC ..... 2/19

(58) Field of Classification Search
USPC ..... 2/16, 19; D29/115
See application file for complete search history.

(56) References Cited

U.S. PATENT DOCUMENTS

| | | | | |
|---|---|---|---|---|
| 2,986,743 | A * | 6/1961 | Eilen | 40/586 |
| 4,516,337 | A * | 5/1985 | Adamik | 36/136 |
| 4,628,543 | A | 12/1986 | Hunt | |
| 4,768,232 | A | 9/1988 | Villalobos | |
| 4,852,276 | A * | 8/1989 | Savoca et al. | 36/136 |
| 5,425,142 | A * | 6/1995 | Scott | 2/19 |
| 5,584,133 | A * | 12/1996 | Motooka et al. | 40/642.02 |
| 5,632,044 | A * | 5/1997 | Sloot | 2/102 |
| 5,678,245 | A | 10/1997 | Rector et al. | |
| 5,694,642 | A | 12/1997 | Rector et al. | |
| 5,704,067 | A * | 1/1998 | Brady | 2/170 |
| 5,924,135 | A * | 7/1999 | Worth | 2/125 |
| 5,933,867 | A | 8/1999 | Corder | |
| 5,943,698 | A | 8/1999 | Blanks | |
| 5,967,917 | A * | 10/1999 | Feeney et al. | 473/604 |
| 5,987,648 | A | 11/1999 | Boyd | |
| 6,061,837 | A | 5/2000 | Oh | |
| 6,182,289 | B1 | 2/2001 | Brown | |
| 6,421,836 | B1 | 7/2002 | Park | |
| 6,449,881 | B1 * | 9/2002 | Assaf et al. | 36/136 |
| 6,455,128 | B1 | 9/2002 | Moon | |
| 6,536,046 | B1 * | 3/2003 | Gilligan | 2/19 |
| D481,864 | S * | 11/2003 | Landry | D2/976 |
| 6,651,368 | B1 * | 11/2003 | Blanks | 40/649 |
| 6,669,582 | B1 | 12/2003 | Beeler | |
| 6,729,058 | B2 * | 5/2004 | Ferguson | 40/636 |
| D531,363 | S * | 10/2006 | Siebers et al. | D29/115 |

(Continued)

FOREIGN PATENT DOCUMENTS

WO WO2009059348 5/2009

OTHER PUBLICATIONS

Author believed to be Easton, no known title, believed to be dated Jul. 2011.

(Continued)

*Primary Examiner* — Shaun R Hurley
(74) *Attorney, Agent, or Firm* — Pamela A. Baxter; Kean miller LLP

(57) ABSTRACT

A glove and a method for making a glove comprising a web region, a finger region, a thumb region, at least one visual indicia aperture, at least one backing member aperture, and wherein at least one backing member, with an attached indicia member, is removably inserted into said backing member aperture.

5 Claims, 8 Drawing Sheets

(56) References Cited

U.S. PATENT DOCUMENTS

| | | | | |
|---|---|---|---|---|
| 7,278,170 | B2 * | 10/2007 | Anderson | 2/19 |
| D580,628 | S * | 11/2008 | Morris | D2/717 |
| 7,454,856 | B2 * | 11/2008 | Passman | 40/661.04 |
| D585,161 | S * | 1/2009 | Aoki et al. | D29/123 |
| 7,854,047 | B2 * | 12/2010 | Wray et al. | 27/19 |
| 8,156,571 | B2 * | 4/2012 | Barzilla | 2/19 |
| 8,453,265 | B2 * | 6/2013 | Forte et al. | 2/115 |
| 2001/0027142 | A1 * | 10/2001 | Kennedy et al. | 473/604 |
| 2005/0187817 | A1 | 8/2005 | Hall et al. | |
| 2005/0268366 | A1 * | 12/2005 | Anderson | 2/19 |
| 2007/0186327 | A1 | 8/2007 | Hall et al. | |
| 2008/0263739 | A1 * | 10/2008 | Streitmann | 2/19 |
| 2009/0038050 | A1 | 2/2009 | Roeckl | |
| 2009/0188141 | A1 | 7/2009 | Asbery et al. | |
| 2010/0248873 | A1 | 9/2010 | Cooper | |
| 2011/0035861 | A1 | 2/2011 | McDonald | |
| 2011/0107493 | A1 | 5/2011 | Watson et al. | |
| 2012/0017344 | A1 * | 1/2012 | Barzilla | 2/19 |

OTHER PUBLICATIONS

Author believed to be Rawlings, unknown catalogue, believed to be dated 2010.

* cited by examiner

BASEBALL GLOVE WITH VISUAL INDICIA

CROSS REFERENCE TO RELATED APPLICATIONS

This application is a non-provisional application of and claims priority to provisional application 61/532,846, filed on Sep. 9, 2011.

STATEMENT REGARDING FEDERALLY SPONSORED RESEARCH OR DEVELOPMENT

Not Applicable.

REFERENCE TO A "SEQUENCE LISTING," A TABLE, OR A COMPUTER PROGRAM

Not Applicable.

Figure 1:
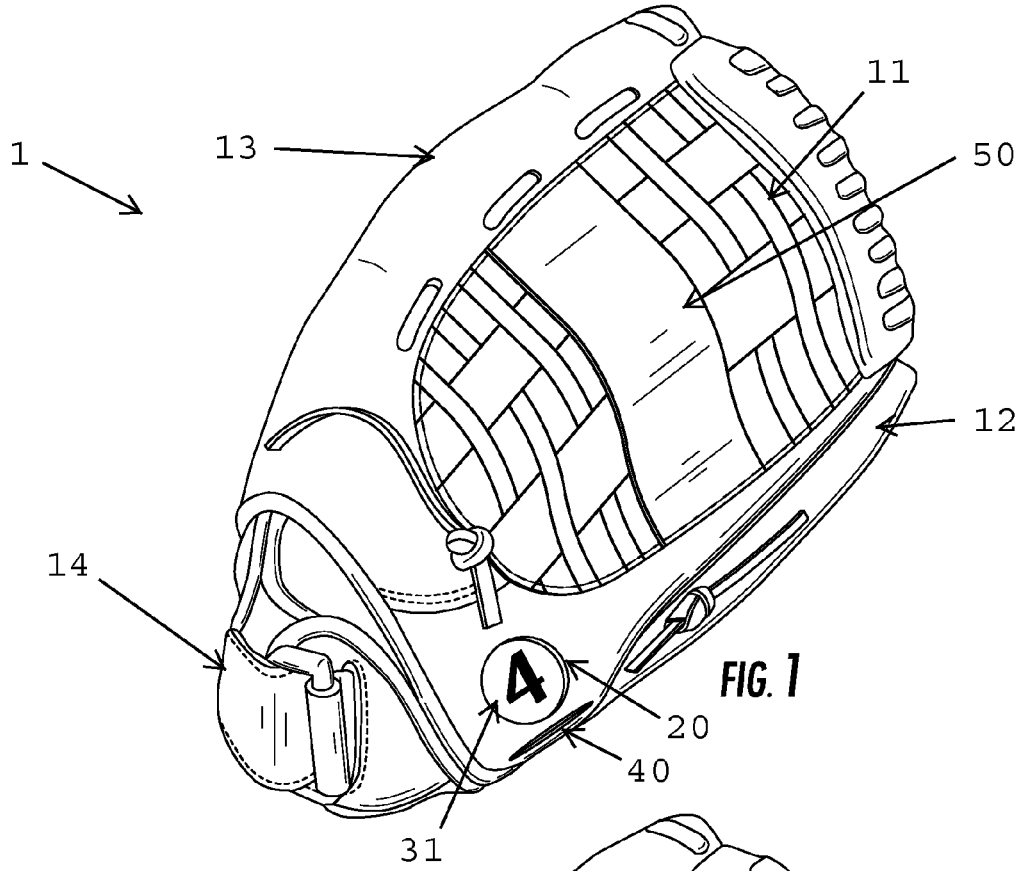
FIG. 1 is a view of an embodiment of the glove with indicia member.
Figure 2:
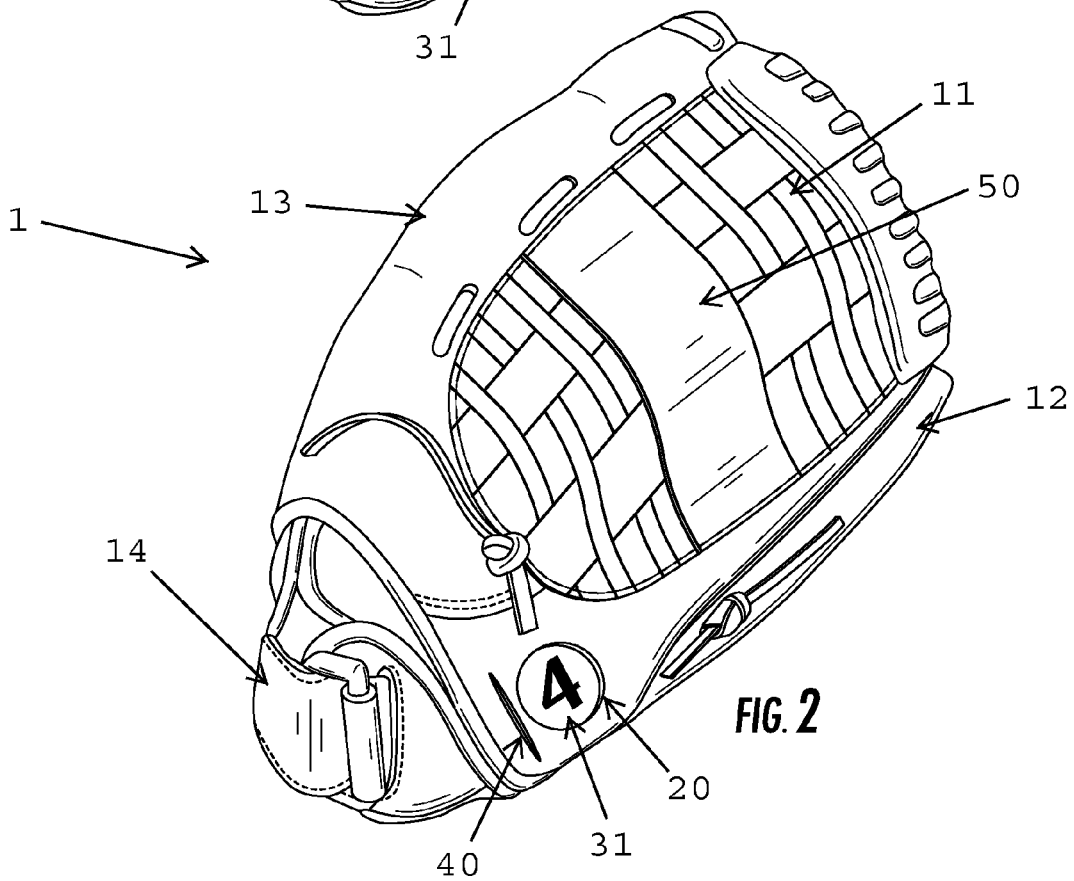
FIG. 2 is a view of an embodiment of the glove with indicia member and an alternate location of the backing member aperture.

The drawings constitute a part of this specification and include exemplary embodiments of a baseball glove with visual indicia, which may be embodied in various forms. It is to be understood that in some instances, various aspects of the baseball glove with visual indicia may be shown exaggerated or enlarged to facilitate an understanding of the baseball glove with visual indicia. Therefore the drawings may not be to scale. Further, while some embodiments are depicted in the drawings, there are additional embodiments discussed in this specification which are not shown in the drawings. Therefore the claims should not be limited to the embodiments disclosed in the drawings but should be construed to include all embodiments discussed in the specification. In addition, in the embodiments depicted herein, like reference numerals in the various drawings refer to identical or near identical structural elements.

DETAILED DESCRIPTION

A baseball glove with visual indicia is disclosed. The terms "baseball glove" and "glove" are used interchangeably and as used herein each term includes the various types of gloves which may be used while playing baseball or softball, including but not limited to, infielder gloves, outfielder gloves, catchers' mitts, pitchers' gloves, softball gloves, etc. The baseball glove comprises a glove body. The glove body may be made from any material known in the art or which may be used in the future to make gloves, including but not limited to, leather or synthetic materials, such as vinyl or plastic, or any combination thereof. Referring now to the figures, the glove body has a ball receiving front side (not shown) and a back side. Glove bodies are well known in the art. The glove body 1 comprises a web region 11, a finger region 13, a thumb region 12, a back side, a front side (not shown), an interior region (not shown) into which the player inserts his or her hand, and an exterior region. Some glove bodies also comprise a wrist strap 14 located on the back side of the glove body. Additionally, some glove bodies comprise a web strap 50 located on the back side of the glove body and extending across the web region 11 of the glove, between the thumb region 12 and the finger region 13.

Figure 7:
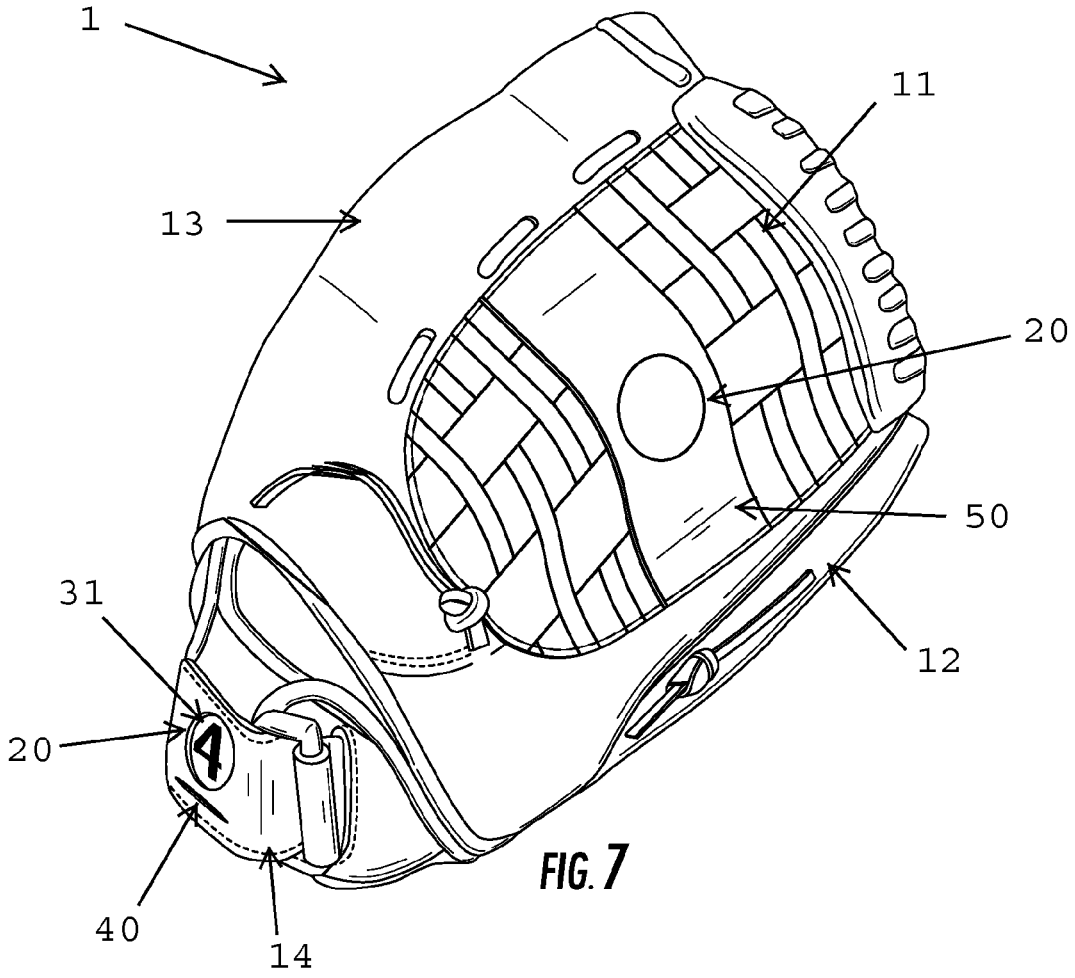
FIG. 7 is a view of an embodiment of the glove showing visual indicia apertures located on the wrist strap and web strap.
Figure 8:
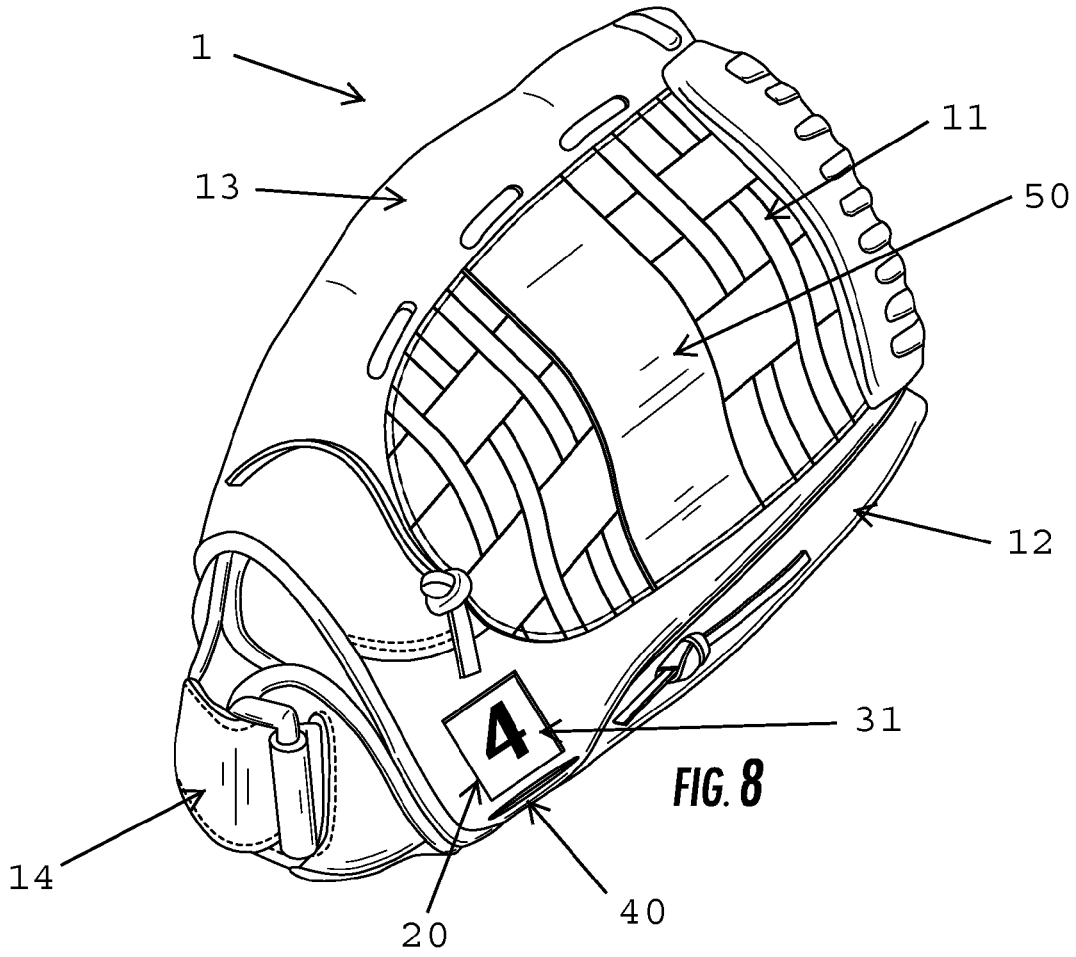
FIG. 8 is a view of an embodiment of the glove with visual indicia.

The back side of the glove 1 has visual indicia aperture 20. In one embodiment, visual indicia aperture 20 is substantially circular, as in FIGS. 1, 2, 3, 5, 6, and 7. However, it is to be understood that visual indicia aperture 20 could be any shape. In another embodiment, visual indicia aperture 20 is substantially oval (not shown). In yet another embodiment, visual indicia aperture 20 is substantially square, as shown in FIG. 8. In a further embodiment, visual indicia aperture 20 is substantially rectangular. The visual indicia aperture 20 may be located in various locations on the back side of the glove.

A backing member 30 is insertable into the interior of the glove, between the exterior surface of the glove and the lining of the glove, as shown in FIGS. 3, 5, 6, and 9. An indicia member 31 is integrally formed with, removably attached to, or permanently or semi-permanently attached to backing member 30, as shown in FIG. 4. As described below, once backing member 30 is inserted into the interior of the glove, indicia member 31 is visible through visual indicia aperture 20, as shown in FIGS. 1, 2, 7, 8, and 9.

Figure 3:
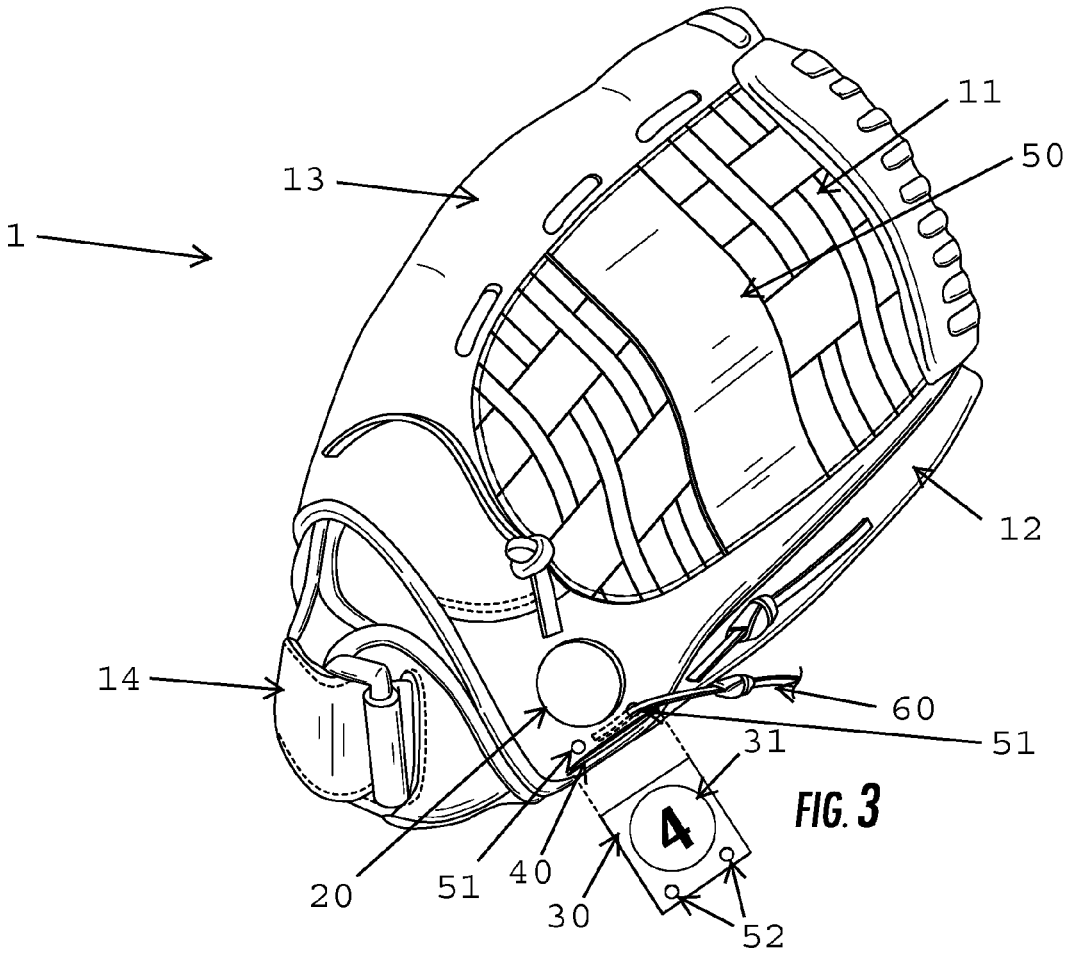
FIG. 3 is a view of an embodiment of the glove showing insertion of backing member into visual indicia aperture through the backing member aperture.
Figure 4:
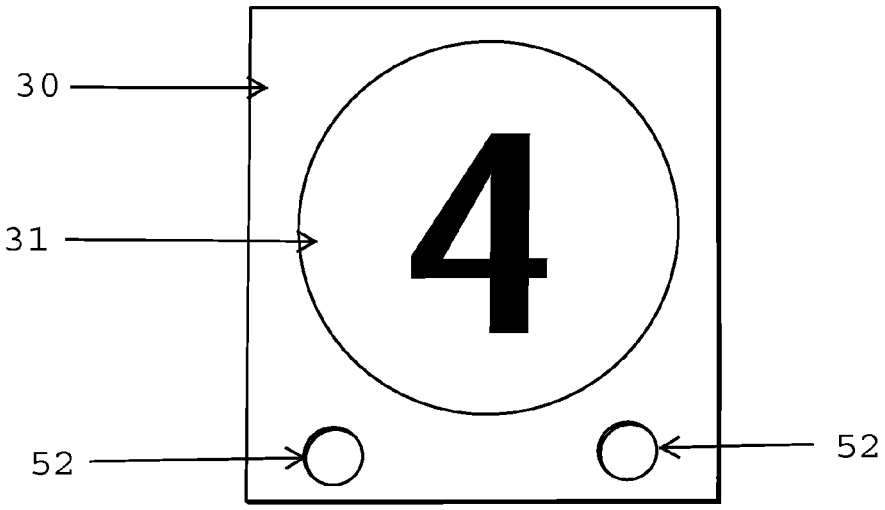
FIG. 4 is a depiction of the backing member with attached indicia member and backing member lace eyelets.
Figure 5:
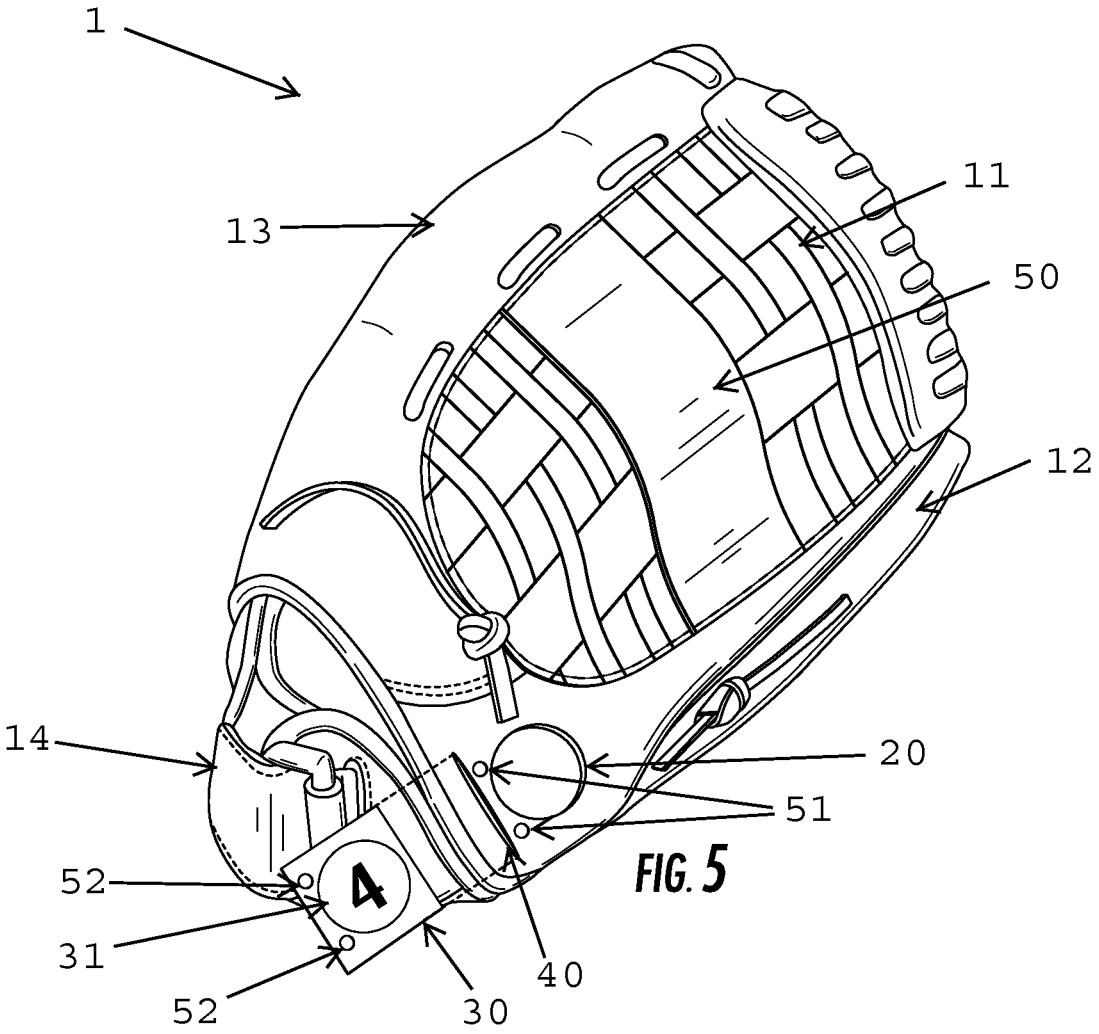
FIG. 5 is a view of an embodiment of the glove showing insertion of backing member, with attached indicia member, through backing member aperture.
Figure 6:
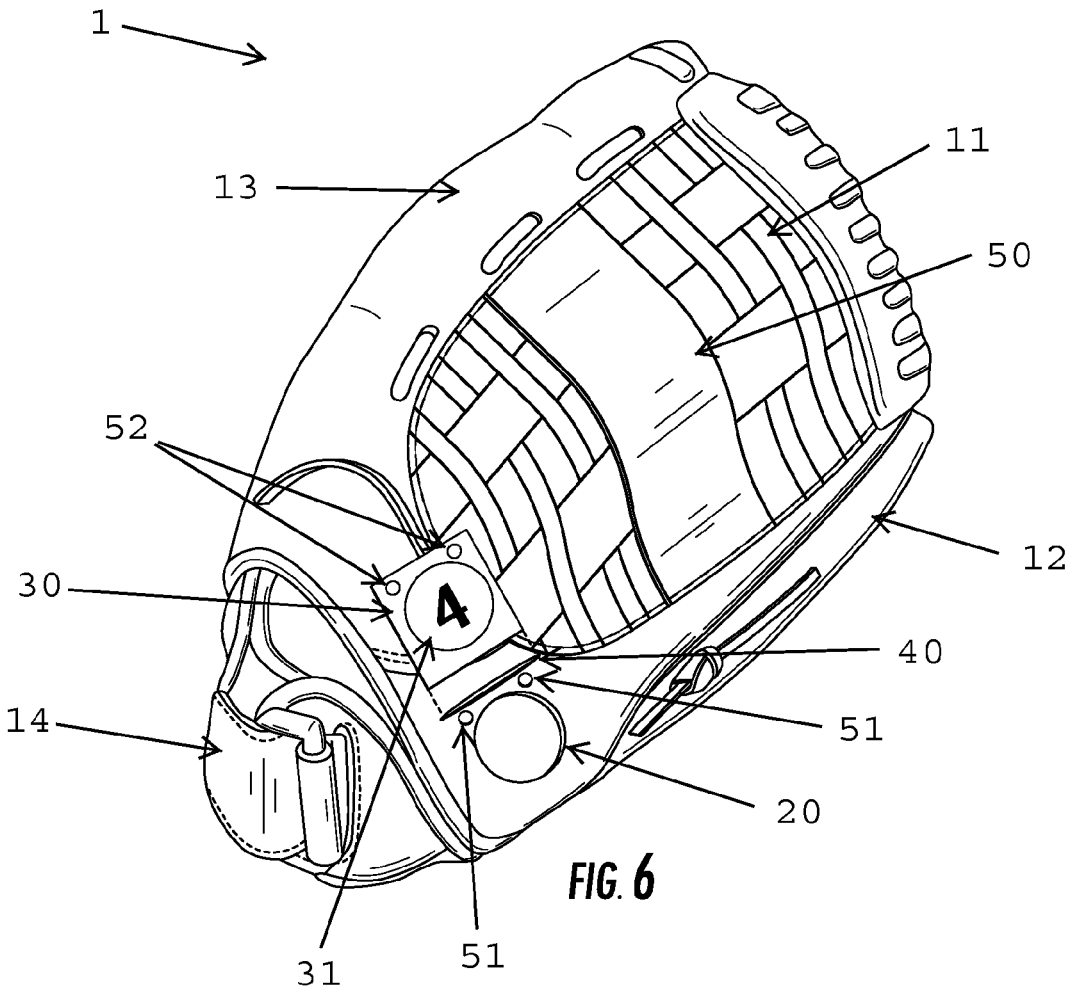
FIG. 6 is a view of an embodiment of the glove showing insertion of backing member, with attached indicia member, through backing member aperture.

In one embodiment, indicia member 31 is substantially circular, as shown in FIG. 4, and is approximately the same diameter as the diameter of visual indicia aperture 20, as shown in FIGS. 3, 5, and 6. However, indicia member 31 may be any shape as long as it is shaped similarly to visual indicia aperture 20. Therefore, indicia member 31 may be substantially oval if visual indicia aperture 20 is substantially oval. In another embodiment, indicia member 31 is substantially square when visual indicia aperture 20 is substantially square, as shown in FIG. 8. In yet another embodiment, indicia member 31 is substantially rectangular when visual indicia aperture 20 is substantially rectangular. In one embodiment, indicia member's 31 thickness is approximately the thickness of the material comprising the back side of the glove, resulting in indicia member 31 being flush with the exterior of the glove once the backing member 30, with attached indicia member 31, is inserted into backing member aperture 40 and indicia member 31 is visible through visual indicia aperture 20. However, in another embodiment, indicia member's 31 thickness is less than the thickness of the material comprising the back side of the glove, resulting in indicia member 31 being recessed when visible through visual indicia aperture 20. In a further embodiment, indicia member 31 is essentially flat. Indicia member 31 may be made from any of the following materials: plastic, synthetics, wool, twill, polyester, canvas, cotton blends, leather, rubber, weatherproof fabrics, or any other suitable material either now known or discovered in the future, or any combination thereof. The indicia member 31 comprises a face and a back (not shown). The face of indicia member 31 may have a design, team logo, professional or college team name, professional team player's number, college team player's number, the player's team name, player's team logo, the player's name, the player's number, or any combination of the foregoing; however, this list is not exclusive. In an alternative embodiment, the user may customize indicia member 31 to any one of the above elements, or to include a phrase, a personal design, etc.

In one embodiment, the back of indicia member 31 is removably attached to backing member 30 through means known in the art, such as hook and loop fasteners such as VELCRO fasteners, a snapping arrangement, or adhesives. In an alternate embodiment, indicia member 31 is permanently or semi-permanently attached to backing member 30 through methods known in the art, including glue, adhesives, and sewing. In a further embodiment, backing member 30 is integrally formed with indicia member 31. In yet another embodiment, backing member 30 may have an indicia painted, printed, or otherwise adhered to the surface of backing member 30, such that the indicia is essentially flat on the surface of backing member 30, so that when backing member 30 is inserted into backing member aperture 40, the indicia is positioned so it can be seen through visual indicia aperture 20 but is recessed within visual indicia aperture 20.

Figure 9:
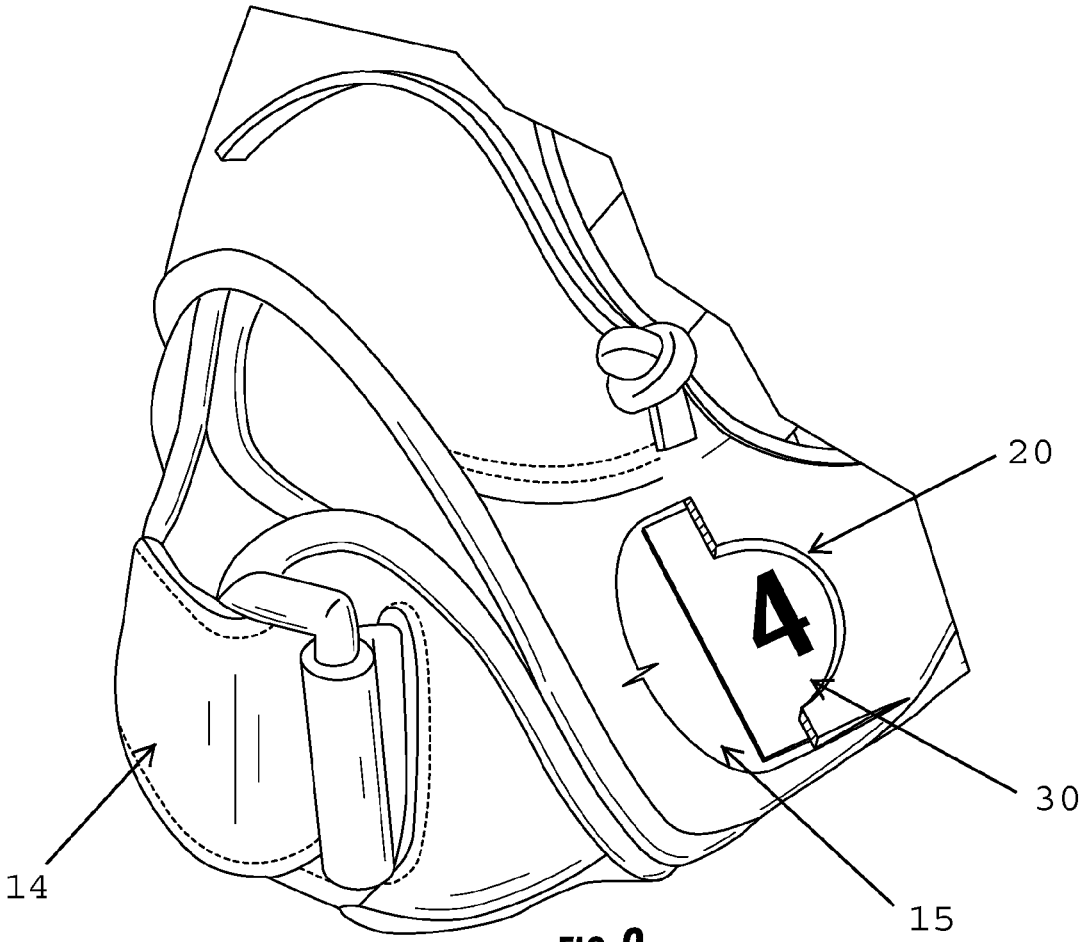
FIG. 9 is a cut-away view of one embodiment of the glove wherein the backing member is inserted into a pocket on the interior of the glove.

In one embodiment, backing member 30 is substantially square in shape, as shown in FIGS. 4 and 9. However, backing member 30 may be any shape as long as it is at least slightly larger than visual indicia aperture 20, and therefore will resist falling or fitting through visual indicia aperture 20 during normal use of the glove. Accordingly, in one embodiment, backing member 30 is substantially circular (not shown). In another embodiment, backing member 30 is substantially oval (not shown). In yet another embodiment, backing member 30 is substantially rectangular (not shown). The backing member 30 is sized so that it is at least slightly larger than visual indicia aperture 20; this results in backing member 30 resisting fitting through or falling out of visual indicia aperture 20 under normal use of the glove, as in playing baseball. In one embodiment, backing member 30 is substantially circular and the diameter of backing member 30 is at least slightly greater than the diameter of visual indicia aperture 20, which is also substantially circular in shape. In another embodiment, backing member 30 is substantially square and is at least slightly wider than the width of visual indicia aperture 20, which is also substantially square in shape. In yet another embodiment, backing member 30 is substantially square and the width of backing member 30 is at least slightly wider than the diameter of visual indicia aperture 20, which is substantially circular in shape. Backing member 30 may be made from any of the following materials: plastic, synthetics, wool, twill, polyester, canvas, cotton blends, leather, rubber, weatherproof fabrics, or any other suitable material either now known or discovered in the future, or any combination thereof.

Backing member 30 is inserted under the exterior material of the back side of the glove, through backing member aperture 40 located on the back side of the exterior of the glove, and positioned so that it is approximately centered behind visual indicia aperture 20, resulting in the visual indicia, located on the attached indicia member 31, being visible through visual indicia aperture 20. Backing member aperture 40 may be located at the bottom of the glove in the interior region of the glove near where the player inserts his or her hand (not shown). In another embodiment, backing member aperture 40 is located on the back side of the glove near visual indicia aperture 20. Backing member aperture 40 may be open to the entire interior region of the glove. In an alternate embodiment, shown in FIG. 9, backing member aperture 40 opens into an interior pocket 15 which is closed off from the remaining interior region of the glove. In another embodiment, interior pocket 15 is only slightly larger than backing member 30. In yet another embodiment, interior pocket 15 has substantially the same shape as backing member 30. In another embodiment, interior pocket 15 is substantially the same size and shape as backing member 30.

The backing member 30 comprises a front side and a back side (not shown). The front side of backing member 30 is the side of backing member 30 to which indicia member 31 attaches, as described above. In one embodiment, the back side of backing member 30 is removably attached to the interior region of the glove. In another embodiment, backing member 30 is removably attached to the glove by having a hook and loop fastener strip, such as VELCRO strips, on both the back side of backing member 30 and on the interior of the glove opposite visual indicia aperture 20 such that when backing member 30 is not in the glove, the hook and loop fastener strip located in the interior region of the glove may be seen through visual indicia aperture 20. In a further embodiment, instead of having a hook and loop fastener strip, such as a VELCRO strip, on the interior of the glove, the interior of the glove comprises a fabric, to which the hook and loop fastener on backing member 30 may be removably attached. In an alternative embodiment, backing member 30 has a hook and loop fastener, such as VELCRO, located on the front side of backing member 30. In this embodiment, the interior of the glove either has a hook and loop fastener, such as VELCRO, or fabric to which the hook and loop fastener, such as VELCRO, will adhere, located on the interior side of the external material of the glove and located adjacent to or around visual indicia aperture 20, so that the hook and loop fastener, such as VELCRO, on the front side of backing member 30 will be removably attached to the interior side of the glove.

Figure 10:
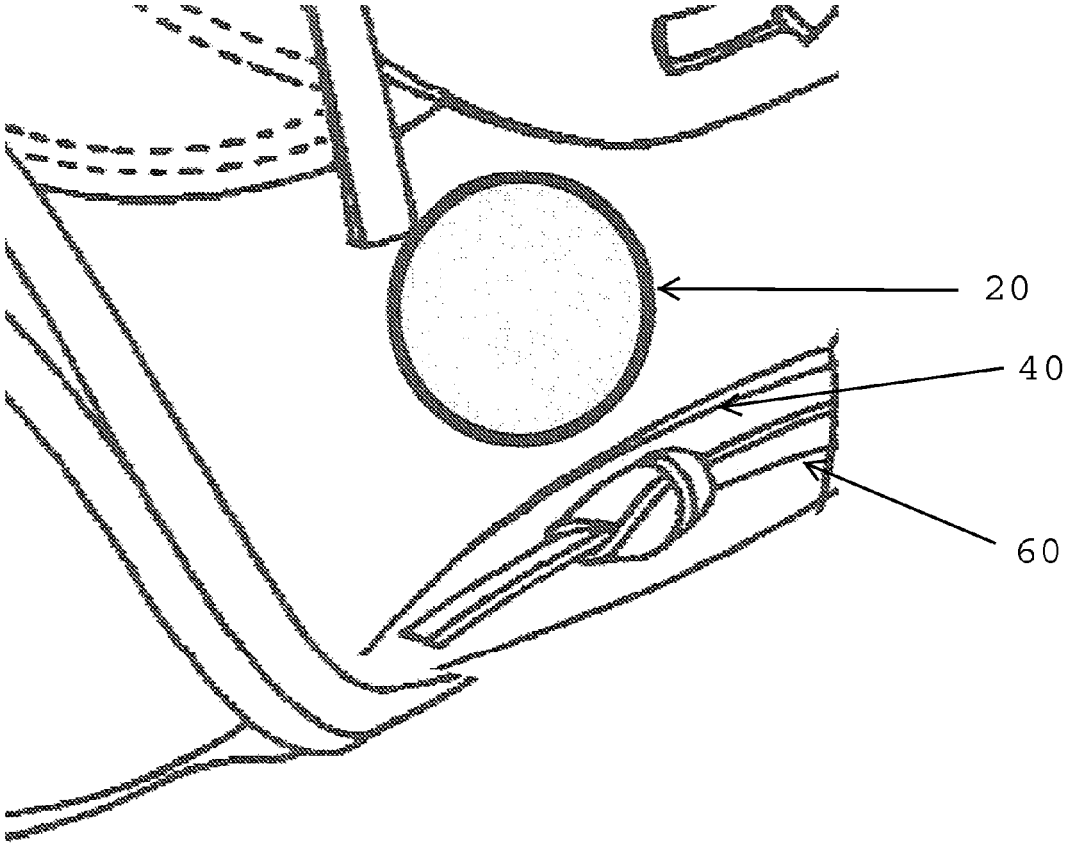
FIG. 10 is a partial image of a glove showing the backing member aperture closed via use of a lace strap inserted through the glove lace eyelets.

In another embodiment, backing member 30 is laced into the glove with at least one lace strap 60. In this embodiment, there are at least two glove lace eyelets 51, located between visual indicia aperture 20 and backing member aperture 40, for inserting at least one lace strap 60 as shown in FIGS. 3, 5, and 6. Backing member 30, with attached indicia member 31, would be inserted into backing member aperture 40 so that indicia member 31 is visible through visual indicia aperture 20, then lace strap 60 would be inserted from the exterior of the glove, through one of the glove lace eyelets 51 and up through the other glove lace eyelet 51 and then lace strap 60 is tied off on the external side of the glove adjacent to each glove lace eyelet 51. In one embodiment, lace strap 60 is tied by using only one knot, by tying it to itself with the two ends which extrude from glove lace eyelets 51, as shown in FIG. 10. In another embodiment, lace strap 60 is tied off on each end which extrudes from glove lace eyelets 51, resulting in two knots when there are two glove lace eyelets 51, as indicated in FIG. 3. Lace strap 60 holds backing member 30 in the glove by closing backing member aperture 40, as shown in FIGS. 3 and 10. In another embodiment, there is only one glove lace eyelet 51. Lace strap 60 would be placed through glove lace eyelet 51 and then tied to itself to close backing member aperture 40. Lace strap 60 may be made of any material which is currently used or which may be used in the future be used to make lacing for gloves, including but not limited to, leather or synthetic materials such as vinyl or plastic, or any combination thereof. Lace strap 60 serves to hold backing member 30 in place and also closes the interior of the glove so that backing member 30 does not fall out of backing member aperture 40.

In an additional embodiment, the interior of the glove has at least two interior lace eyelets (not shown). In this embodiment, the external material of the glove has at least two glove lace eyelets 51, and lace strap 60 will be placed through one glove lace eyelet 51, through one of the interior lace eyelets, and then up through another interior lace eyelet and then out through a second glove lace eyelet 51 and tied off on the external side of the glove. In embodiments where the glove only has one glove lace eyelet 51, the interior of the glove also has only one interior lace eyelet. However, the number of interior lace eyelets may be different from the number of glove lace eyelets 51. Lace strap 60 secures backing member 30 in the glove by closing backing member aperture 40.

In another embodiment, backing member 30 also comprises at least two backing member lace eyelets 52. In this embodiment, backing member lace eyelets 52 substantially align with glove lace eyelets 51 when indicia member 31 is visible through visual indicia aperture 20. In another embodiment, the interior of the glove has interior lace eyelets, and backing member lace eyelets 52 are substantially aligned with the interior lace eyelets as well as with glove lace eyelets 51. The number of interior lace eyelets, backing member lace eyelets 52, and glove lace eyelets 51 does not have to be the same. Once at least one of the backing member lace eyelets 52 is substantially aligned with at least one of the glove lace eyelets 51, lace strap 60 is inserted from the exterior of the glove, through a first glove lace eyelet 51, through a substantially aligned first backing member lace eyelet 52, behind backing member 30, and then up through a second backing member lace eyelet 52, a second glove lace eyelet 51, and out to the exterior region of the glove. In an alternate embodiment, at least two backing member lace eyelets 52 are substantially aligned with at least two of the glove lace eyelets 51. Lace strap 60 is then tied off adjacent to each glove lace eyelet 51 on the exterior side of the glove, thereby securing backing member 30 inside the glove. In embodiments where there are interior lace eyelets, lace strap 60 is inserted from the exterior of the glove through one glove lace eyelet 51, through the aligned backing member lace eyelet 52, through the aligned interior lace eyelet, and then up through a second interior lace eyelet, through a second backing member lace eyelet 52, through a second glove lace eyelet 51 and out to the exterior region of the glove where lace strap 60 is tied off adjacent to each glove lace eyelet 51.

In yet another embodiment, when backing member aperture 40 is located in the interior region of the glove, the glove comprises at least two glove lace eyelets 51 and the interior of the glove also comprises at least two interior lace eyelets; in this embodiment, backing member 30 is held in place by lace strap 60 securing backing member aperture 40 without the need for any backing member lace eyelets. In a further embodiment, backing member 30 may also comprise backing member lace eyelets 52, as described above. In another embodiment, there is only one glove lace eyelet 51 and only one interior lace eyelet. In a further embodiment, there is only one glove lace eyelet 51, only one interior lace eyelet, and only one backing member lace eyelet 52.

The above described elements of hook and loop fastenings, such as VELCRO fastenings, and lace straps may be used alone or in combination. Therefore in one embodiment, backing member 30 comprises a hook and loop fastener strip, such as a VELCRO strip, either on the front side or back side of backing member 30, which removably fastens to a hook and loop fastener strip, such as a VELCRO strip, located in the interior region of the glove either opposite visual indicia aperture 20 or adjacent to visual indicia aperture 20, backing member 30 further comprises backing member lace eyelets 52, and the glove comprises glove lace eyelets 51 and interior lace eyelets. In this embodiment, backing member 30 is held in place by the hook and loop fasteners, such as VELCRO Velcro fasteners,. and lace strap 60, as described above. In another embodiment, backing member 30 comprises a hook and loop fastener strip, such as a VELCRO strip, either on the front side or back side of backing member 30, which removably fastens to a hook and loop fastener strip, such as a VELCRO strip, located in the interior region of the glove, either opposite visual indicia aperture 20 or adjacent to visual indicia aperture 20, and the glove comprises glove lace eyelets 51 and interior lace eyelets. In this embodiment, backing member 30 is held in place by the hook and loop fasteners, such as VELCRO fasteners, and lace strap 60, as described above. In another embodiment, backing member 30 comprises a hook and loop fastener strip, such as a VELCRO strip, located on either the front side or back side of backing member 30, which removably fastens to the fabric on the interior region of the glove, backing member 30 further comprises backing member lace eyelets 52, and the glove comprises glove lace eyelets 51 and interior lace eyelets. In a further embodiment, backing member 30 comprises a hook and loop fastener strip, such as a VELCRO strip, located on either the front side or back side of backing member 30, which removably fastens to the fabric on the interior region of the glove, and the glove comprises glove lace eyelets 51. In yet a further embodiment, backing member 30 is only held in place by a hook and loop fastener, such as VELCRO, either located solely on backing member 30, or located on both backing member 30 and the interior region of the glove, as described above. In another embodiment, backing member 30 is held in place only by use of lace strap 60, as described above. The backing member 30 can have backing member eyelets 52 and the glove may also have glove lace eyelets 51. However, in a further embodiment, backing member 30 does not have backing member lace eyelets and backing member 30 is held in place solely by use of lace strap 60 which is inserted through the glove member eyelets 51. In yet another embodiment, backing member 30 is held in place solely by friction, i.e. there are no eyelets or hook and loop fasteners, such as VELCRO or other fasteners holding backing member 30 in place. This is not intended to be an exhaustive list of all the variations which may be possible.

Visual indicia aperture 20 may be located along thumb region 12 of the back side of glove 1, as shown in FIGS. 1, 2, 3, 5, 6, 8, and 9. In one embodiment, visual indicia aperture 20 is located at the base of thumb region 12 of the back side of the glove, adjacent to the opening of the glove in which a player inserts his or her hand. In another embodiment, visual indicia aperture 20 is located along the index finger portion of finger region 13 of the back side of the glove. In yet another embodiment, visual indicia aperture 20 is located on web region 11 of the back side of the glove. In yet another embodiment, visual indicia aperture 20 is located on wrist strap 14 of the glove. In another embodiment, visual indicia aperture 20 is located on the back side of the glove adjacent to the opening into which a player inserts his or her hand. In a further embodiment, the glove has a web strap 50 which is located along the back side of the glove across the web region 11 of the back side of the glove. In this embodiment, web strap 50 is made from any material from which the exterior of the glove may be made, including but not limited to, leather, or synthetic materials, such as vinyl or plastic. Web strap 50 is sewn or otherwise fastened to the back side of the glove on either side of the web region 11 of the glove. In one embodiment, visual indicia aperture 20 is located on web strap 50, as shown in FIG. 7. In this embodiment, backing member aperture 40 may be located on either the top side or bottom side of the web strap 50 along the side seam of web strap 50. In another embodiment, backing member aperture 40 is located adjacent to visual indicia aperture 20 on the front of web strap 50. In yet another embodiment, web strap 50 comprises glove lace eyelets 51, as described previously. In this embodiment, web strap 50 may comprise additional eyelets on the underside of web strap 50 such that lace strap 60 would go from one side of web strap 50 through the other side of web strap 50 via the glove lace eyelets, to secure backing member 30 from falling out of backing member aperture 40.

The baseball glove with visual indicia is made according to known methods. When making the glove, visual indicia aperture 20 is cut into the material forming the exterior back side of the glove in any of the above mentioned locations on the back side of the glove or on a web strap 50 or wrist strap 14 which is fastened to the backside of the glove. Then backing member 30 is inserted in between the material forming the exterior surface of the back side of the glove and the material located on the interior of the glove. The user or purchaser of the glove may then buy different indicia members 31 and removably attach indicia member 31 to backing member 30, or buy an indicia member 31 permanently or semi-permanently attached to backing member 30. In one embodiment, indicia member 31 is flush with the exterior of the glove, and resists removal while a player is using the glove. However, in another embodiment, indicia member 31 is not flush with the exterior of the glove, but is recessed in relation to the exterior of the glove. In embodiments where indicia member 31 is removably attached to backing member 30, the user may easily switch indicia member 31 to a different indicia member 31. In embodiments where backing member 30 is permanently or semi-permanently attached to indicia member 31, a user may easily switch indicia member 31 by simply removing backing member 30 from the glove and inserting either a different backing member 30 that is removably attached to a different indicia member 31, or another backing member 30 which is permanently or semi-permanently attached to a different indicia member 31. The glove can either come with backing member 30 already installed, or the user may install backing member 30 after purchasing the glove.

Alternatively, an existing baseball glove may be modified so that a visual indicia aperture 20 and backing member aperture 40 are cut into the back side of the glove. The glove is then ready to have a backing member 30 inserted into visual indicia aperture 20 through the backing member aperture 40.

The term "eyelets," as used herein, refers to a hole in the material and therefore may be any shape and are not necessarily circular. Therefore, in one embodiment the eyelets are substantially circular. In another embodiment, the eyelets are substantially square. In a further embodiment, the eyelets are substantially oval. In yet another embodiment, the eyelets are slits in the material.

For the purpose of understanding the baseball glove with visual indicia, references are made in the text to exemplary embodiments of a baseball glove with visual indicia, only some of which are described herein. It should be understood that no limitations on the scope of the invention are intended by describing these exemplary embodiments. Further, some of the above mentioned embodiments may be used alone or in combination. One of ordinary skill in the art will readily appreciate that alternate but functionally equivalent components, materials, designs, and equipment may be used. The inclusion of additional elements may be deemed readily apparent and obvious to one of ordinary skill in the art. Specific elements disclosed herein are not to be interpreted as limiting, but rather as a basis for the claims and as a representative basis for teaching one of ordinary skill in the art to employ the present invention.

There are many ways of making a glove, including web design, etc, etc, which are known in the art.

Moreover, the terms "substantially" or "approximately" as used herein may be applied to modify any quantitative representation that could permissibly vary without resulting in a change to the basic function to which it is related.

The invention claimed is:

1. A glove comprising:

a. a web region;

b. a finger region;

c. a thumb region;

d. at least one visual indicia aperture;

e. at least two glove lace eyelets, a first glove lace eyelet and a second glove lace eyelet; and f. at least one lace strap removably inserted through both said first glove lace eyelet and said second glove lace eyelet;

wherein at least one backing member, with an attached indicia member, is removably inserted into said backing member aperture, and wherein both said first glove lace eyelet and said second glove lace eyelet are located between said visual indicia aperture and said backing member aperture.

2. The glove of claim 1, further comprising a first interior lace eyelet and a second interior lace eyelet, both said first interior lace eyelet and said second interior lace eyelet located on the interior of said glove, said first interior lace eyelet being substantially aligned with said first glove lace eyelet, and said second interior lace eyelet being substantially aligned with said second glove lace eyelet, wherein said lace strap is removably inserted through said first glove lace eyelet, said first interior lace eyelet, said second interior lace eyelet, and said second glove lace eyelet.

3. The glove of claim 2, wherein said backing member further comprises a first backing member lace eyelet and a second backing member lace eyelet, wherein said lace strap is removably inserted through said first glove lace eyelet, said first backing member lace eyelet, said first interior lace eyelet, said second interior lace eyelet, said second backing member lace eyelet, and said second glove lace eyelet.

4. The glove of claim 1, wherein said backing member further comprises a first backing member lace eyelet and a second backing member lace eyelet, wherein said lace strap is removably inserted through said first glove lace eyelet, said first backing member, lace eyelet, said second backing member lace eyelet, and said second glove lace eyelet.

5. The glove of claim 1, wherein said indicia member is attached to said backing member by sewing said indicia member onto said backing member.

* * * * *